US010851803B2

(12) United States Patent
Higuchi

(10) Patent No.: US 10,851,803 B2
(45) Date of Patent: Dec. 1, 2020

(54) MULTI-STAGE CENTRIFUGAL COMPRESSOR

(71) Applicant: MITSUBISHI HEAVY INDUSTRIES COMPRESSOR CORPORATION, Tokyo (JP)

(72) Inventor: Hirofumi Higuchi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 185 days.

(21) Appl. No.: 15/776,650

(22) PCT Filed: Nov. 30, 2015

(86) PCT No.: PCT/JP2015/083580
§ 371 (c)(1),
(2) Date: May 16, 2018

(87) PCT Pub. No.: WO2017/094064
PCT Pub. Date: Jun. 8, 2017

(65) Prior Publication Data
US 2018/0372121 A1 Dec. 27, 2018

(51) Int. Cl.
*F04D 29/70* (2006.01)
*F04D 17/12* (2006.01)
(Continued)

(52) U.S. Cl.
CPC ..... *F04D 29/701* (2013.01); *F04D 17/12* (2013.01); *F04D 17/122* (2013.01);
(Continued)

(58) Field of Classification Search
CPC ..... F04D 29/701; F04D 17/12; F04D 17/122; F04D 17/125; F04D 29/286;
(Continued)

(56) References Cited

U.S. PATENT DOCUMENTS 8,845,281 B2 * 9/2014 Cerretelli ..... F04D 29/023 415/169.2
2012/0195740 A1 8/2012 Karishuku
2013/0058769 A1 3/2013 Sassanelli et al.

FOREIGN PATENT DOCUMENTS

CN 2756872 Y 2/2006
DE 235397 C 6/1911
(Continued)

OTHER PUBLICATIONS

International Search Report issued in corresponding International Application No. PCT/JP2015/083580 dated Mar. 1, 2016 (4 pages).
(Continued)

*Primary Examiner* — Courtney D Heinle
*Assistant Examiner* — Eric J Zamora Alvarez
(74) *Attorney, Agent, or Firm* — Osha Bergman Watanabe & Burton LLP

(57) ABSTRACT

A multi-stage centrifugal compressor includes: a rotor including a plurality of impellers disposed in a plurality of stages in an axial direction; a plurality of diaphragms each including a guide flow path that guides a fluid discharged radially outward from one of the impellers to an adjacent impeller on the following stage, and a communication hole extended from a bottom portion of the guide flow path; a casing that accommodates the plurality of diaphragms therein; and an axial flow path that connects the plurality of communication holes to each other. The casing includes a drain flow path disposed only between the communication hole that is the closest to a suction nozzle and the communication hole that is the closest to an ejection nozzle.

12 Claims, 4 Drawing Sheets

(51) Int. Cl.
*F04D 29/28* (2006.01)
*F04D 29/42* (2006.01)
*F04D 29/44* (2006.01)

(52) U.S. Cl.
CPC ..... *F04D 17/125* (2013.01); *F04D 29/286* (2013.01); *F04D 29/4206* (2013.01); *F04D 29/441* (2013.01); *F04D 29/706* (2013.01); *F05D 2260/602* (2013.01)

(58) Field of Classification Search
CPC .. F04D 29/4206; F04D 29/441; F04D 29/706; F05D 2260/602
See application file for complete search history.

(56) References Cited

FOREIGN PATENT DOCUMENTS

| | | | |
|---|---|---|---|
| JP | S53-130503 | U | 10/1978 |
| JP | S55-007914 | A | 1/1980 |
| JP | H08-338397 | A | 12/1996 |
| JP | 2012-154290 | A | 8/2012 |

OTHER PUBLICATIONS

Written Opinion issued in corresponding International Application No. PCT/JP2015/083580 dated Mar. 1, 2016 (7 pages).

* cited by examiner

MULTI-STAGE CENTRIFUGAL COMPRESSOR

TECHNICAL FIELD

The present invention relates to a multi-stage centrifugal compressor.

BACKGROUND

The centrifugal compressor allows a working fluid to flow on the inside of a rotating impeller. Accordingly, the centrifugal compressor compresses the working fluid in a gas state by utilizing a centrifugal force generated when the impeller rotates. As a centrifugal compressor, a multi-stage centrifugal compressor is known which includes a plurality of impellers so as to compress the working fluid in stages.

In the multi-stage centrifugal compressor, a plurality of diaphragms are integrally linked to each other side by side in an axial direction of a rotation shaft on the inside of a casing. In the plurality of diaphragms, flow paths, such as a suction flow path, a diffuser flow path, a curved flow path, a return flow path, and a discharge flow path, through which the working fluid flows are formed on the inside thereof. In such a multi-stage centrifugal compressor, there is a case where the working fluid in the flow path liquefies when the operation is stopped or the like.

The multi-stage centrifugal compressor includes a drain portion which discharges the working fluid that has been liquefied and accumulated in the flow path to the outside of a casing. For example, in the centrifugal compressor described in PTL 1, drain flow paths which extend from the flow path in the diaphragm downward toward a bottom portion on the inside of the casing are each formed in a lower portion of the plurality of diaphragms. The drain flow path is connected to a drain pipe which extends from the bottom portion of the casing toward the outside in order to deliver the liquid to the outside of the casing. Therefore, the liquid accumulated in the flow path passes through the drain flow path, is discharged to the outside of the diaphragm, and then, can be discharged to the outside of the casing through the drain pipe.

Incidentally, in a multi-stage centrifugal compressor, a suction nozzle is provided which allows a working fluid to flow into a flow path in a casing, and an ejection nozzle is provided which allows the compressed working fluid to flow to the outside of the casing through the flow path in the casing. In many cases, the suction nozzle and the ejection nozzle are provided so as to extend downward from the bottom portion of the casing. Therefore, the plurality of drain pipes which extend downward of the casing, the suction nozzle and the ejection nozzle are aligned along an axial direction of a rotation shaft below the casing.

As a result, there is a case where the plurality of drain pipes, the suction nozzle, and the ejection nozzle interfere with each other in the axial direction. In order to avoid the interference, it is necessary to lengthen the rotation shaft (rotor main body) of the multi-stage centrifugal compressor in the axial direction and widen an interval in the axial direction among the plurality of drain pipes, the suction nozzle, and the ejection nozzle.

CITATION LIST

Patent Literature

[PTL 1] Japanese Unexamined Patent Application, First Publication No. H08-338397

However, as the rotation shaft becomes longer, the natural frequency of the rotation shaft becomes smaller. As a result, as the frequency becomes close to the rotational frequency of the rotation shaft during an operation of the centrifugal compressor, resonation is likely to occur, and thus, vibration increases in some cases. Therefore, there is demand for providing a drain flow path while avoiding interference between the suction nozzle and the ejection nozzle without lengthening the rotor main body.

SUMMARY

One or more embodiments of the invention provide a multi-stage centrifugal compressor which can provide a drain flow path while avoiding the interference between a suction nozzle and an ejection nozzle without lengthening a rotor main body.

According to one or more embodiments of the invention, there is provided a multi-stage centrifugal compressor including: a rotor including a rotor main body which extends along an axis, and impellers which are fixed to an outer surface of the rotor main body and provided in a plurality of stages in an axial direction; a diaphragm including a guide flow path for guiding a fluid discharged radially outward from the impeller radially inward, and a communication hole which extends downward in a perpendicular direction from a bottom portion of the guide flow path; a casing which accommodates a plurality of the diaphragms which are arranged in the axial direction corresponding to each of the plurality of stages of the impellers therein; and an axial flow path which extends in the axial direction so as to connect a plurality of the communication holes to each other, in which the casing includes a suction nozzle which is provided on a first end portion side in the axial direction and guides a working fluid from the outside of the casing to the impeller on a first stage on the first end portion side, an ejection nozzle which is provided on a second end portion side in the axial direction and ejects the working fluid discharged from the impeller on the final stage on the second end portion side to the outside of the casing, and a drain flow path which is provided only between the communication hole formed at a position that is the closest to the suction nozzle in the axial direction and the communication hole formed at a position that is the closest to the ejection nozzle in the axial direction, and causes the axial flow path and the outside of the casing to communicate with each other.

According to one or more embodiments, the fluid which exists in the guide flow path formed in the diaphragm flows from the bottom portion of the guide flow path through the communication hole into the axial flow path. The fluid that flows into the axial flow path is discharged from the drain flow path to the outside of the casing. The drain flow path is provided between the communication hole formed at the position that is the closest to the suction nozzle and the communication hole formed at the position that is the closest to the ejection nozzle. Therefore, it is possible to form a drain flow path on the inside of the suction nozzle in the axial direction and on the inside of the ejection nozzle in the axial direction. Therefore, even when there is a member disposed on the outside of the casing similar to the drain pipe connected to the drain flow path, it is possible to dispose the member at a position that does not interfere with the suction nozzle and the ejection nozzle.

In the multi-stage centrifugal compressor according to one or more embodiments of the invention, in the first aspect, the axial flow path may be formed by a gap provided between an outer circumferential surface of the diaphragm and an inner circumferential surface of the casing.

According to one or more embodiments, when the plurality of diaphragms are provided with respect to the casing, the gap formed between the outer circumferential surface of the diaphragm and the inner circumferential surface of the casing can be made to be the axial flow path. Therefore, it is not necessary to form grooves or the like in order to form the axial flow path, and it is possible to provide the axial flow path at low cost.

In the multi-stage centrifugal compressor according to one or more embodiments of the invention, in the first aspect, the axial flow path may be formed by a groove provided on an outer circumferential surface of the diaphragm.

According to one or more embodiments, it is possible to provide the axial flow path having a sufficient flow path sectional area in a necessary region in the axial direction by the groove recessed from the outer circumferential surface of the diaphragm.

In the multi-stage centrifugal compressor according to one or more embodiments of the invention, in any one of the first to third aspects, only one drain flow path may be provided.

According to one or more embodiments, it is possible to provide the drain flow path so as not to reliably interfere with the suction nozzle and the ejection nozzle.

In the multi-stage centrifugal compressor according to one or more embodiments of the invention, in any one of the first to fifth aspects, the multi-stage centrifugal compressor may further include a suction portion which suctions out the fluid from the axial flow path in the casing.

According to one or more embodiments, the fluid that has flowed into the axial flow path from the communication hole provided in the plurality of stages of the guide flow path can be suctioned out by the suction portion. Accordingly, it is possible to reliably discharge the fluid from the drain flow path to the outside of the casing.

According to one or more embodiments of the present invention, it is possible to provide the drain pipe while avoiding interference between the suction nozzle and the ejection nozzle without lengthening the rotor main body.

DETAILED DESCRIPTION

Figure 1:
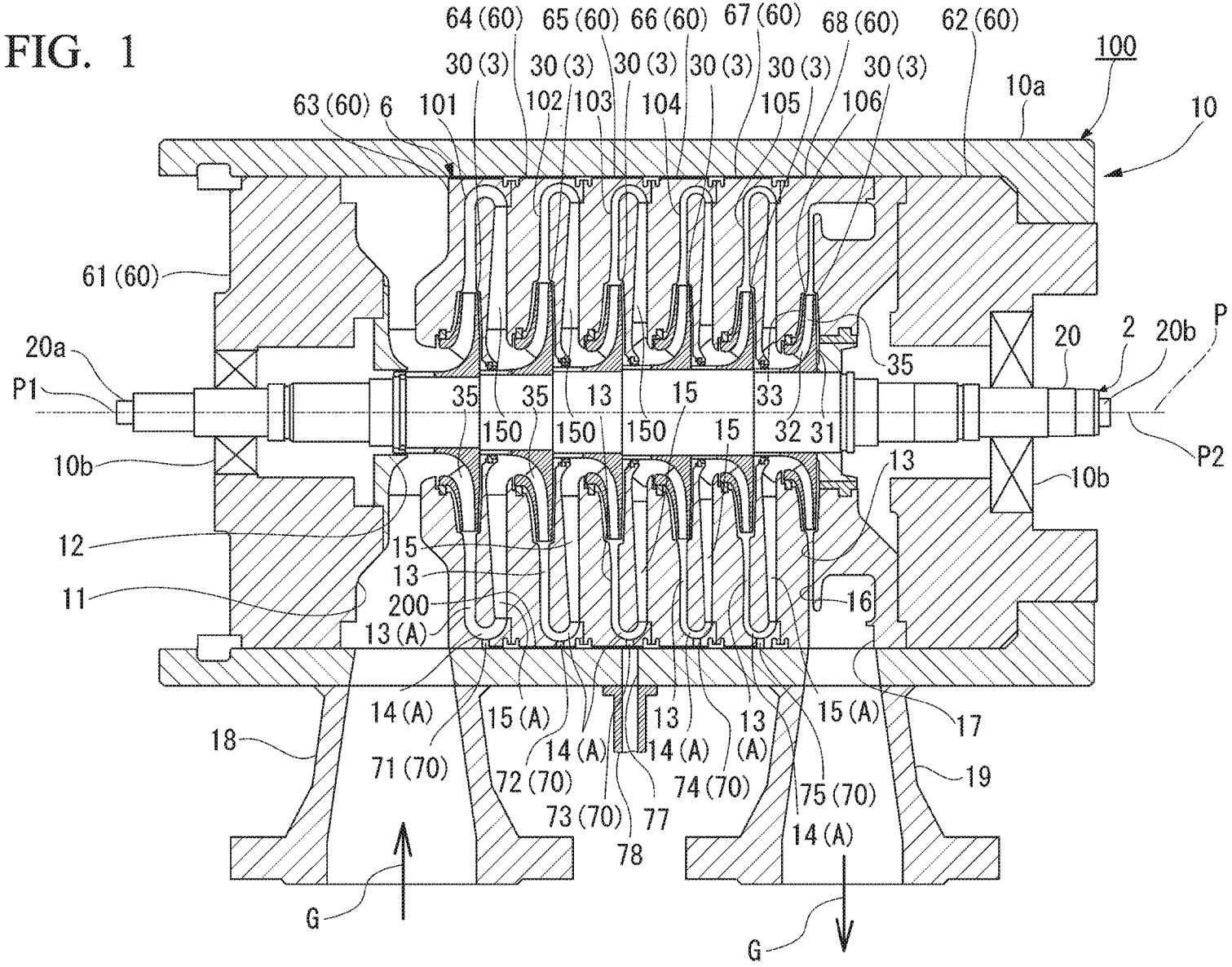
FIG. 1 is a sectional view illustrating the overall configuration of a multi-stage centrifugal compressor according to one or more embodiments of the invention.

Hereinafter, embodiments of the present invention will be described with reference to FIGS. 1 and 2. As illustrated in FIG. 1, a compressor according to one or more embodiments is a single-shaft multi-stage centrifugal compressor (multi-stage centrifugal compressor) 100 having a plurality of impellers 30.

The centrifugal compressor 100 includes a rotor 2 which rotates around an axis P and a casing unit 10 which covers the rotor 2 from an outer circumferential side.

The rotor 2 has a rotor main body (rotation shaft) 20 which extends along the axis P, and the plurality of impellers 30 which rotate together with the rotor main body 20.

A driving machine (not illustrated), such as a motor, is linked to the rotor main body 20. The rotor main body 20 is rotationally driven by the driving machine. The rotor main body 20 has a columnar shape with the axis P as the center and extends in an axial direction in which the axis P extends. Both ends of the rotor main body 20 in the axial direction are rotatably supported by a bearing 10*b* which will be described later.

The impeller 30 is fixed to an outer surface of the rotor main body 20. The impeller 30 compresses a process gas (working fluid) G by using a centrifugal force by rotating together with the rotor main body 20. The impeller 30 is provided in a plurality of stages in the axial direction with respect to the rotor main body 20. The impellers 30 in accordance with one or more embodiments are disposed between the bearings 10*b* disposed on both sides in the axial direction with respect to the rotor main body 20. The impeller 30 is a so-called closed type impeller including a disk 31, a blade 32, and a cover 33.

Each of the disks 31 is formed in a disk shape which gradually expands radially outwardly of the rotor main body 20 from a first end portion P1 side in the axial direction of the rotor main body 20 toward a second end portion P2 side.

The blade 32 is formed so as to protrude from the disk 31 in the axial direction. A plurality of blades 32 are formed at predetermined intervals in a circumferential direction of the rotor main body 20.

The cover 33 covers the plurality of blades 32 from the side opposite to the disk 31 in the axial direction. The cover 33 is formed in a disc shape that faces the disk 31.

In the impeller 30, an impeller flow path 35 is defined on the inside by the disk 31, the blade 32, and the cover 33. The impeller flow path 35 discharges the compressed process gas G that flows in from an inlet on the first end portion P1 side which is the upstream side in the axial direction to an outlet on the outside in the radial direction.

An impeller group 3 is configured with a plurality of impellers 30 arranged along the axial direction. The centrifugal compressor 100 in accordance with one or more embodiments has one impeller group 3.

The centrifugal compressor 100 in accordance with one or more embodiments has six compressor stages including a first compressor stage 101, a second compressor stage 102, a third compressor stage 103, a fourth compressor stage 104, a fifth compressor stage 105, a sixth compressor stage 106, corresponding to six impellers 30 in the axial direction of the impeller group 3.

In the centrifugal compressor 100 in accordance with one or more embodiments, the first end portion P1 side in the axial direction is defined as the upstream side. Further, in the centrifugal compressor 100, the second end portion P2 side in the axial direction is defined as the downstream side. In the centrifugal compressor 100, the process gas G flows while being compressed in stages from the upstream side to the downstream side.

Here, the first end portion P1 side in the axial direction is one end 20*a* side of the rotor main body 20 and is a left side of the paper surface of FIG. 1. In addition, the second end portion P2 side in the axial direction is the other end 20*b* side opposite to the one end 20*a* side of the rotor main body 20 and is a right side of the paper surface of FIG. 1.

The casing unit 10 has a casing (outer casing) 10*a*, a diaphragm group 6, and bearings 10*b*.

The casing 10*a* forms an exterior of the centrifugal compressor 100. The casing 10*a* is formed in a cylindrical shape. The casing 10*a* is formed such that the central axis thereof matches the axis P of the rotor main body 20. The casing 10*a* accommodates the diaphragm group 6 on the inside thereof.

One bearing 10*b* is provided one by one in both of the end portions of the rotor main body 20. The bearing 10*b* rotatably supports the rotor main body 20. The bearings 10*b* are respectively attached to a first end portion side diaphragm 61 and a second end portion side diaphragm 62 which will be described later respectively.

The diaphragm group 6 is accommodated on the inside of the casing 10*a*. The diaphragm group 6 is disposed in the space between the casing 10*a* and the rotor 2. The diaphragm group 6 is configured with a plurality of diaphragms 60 arranged in the axial direction corresponding to each of the plurality of stages of impellers 30. The diaphragm group 6 in accordance with one or more embodiments respectively forms at least one of an inlet flow path to the impeller 30 that corresponds to each of the compressor stages and an outlet flow path from the impeller 30. The plurality of diaphragms 60 are arranged so as to be laminated in the axial direction. The diaphragm 60 is connected to each other to define a flow path through which the process gas G flows.

The diaphragm group 6 in accordance with one or more embodiments is configured with the plurality of diaphragms 60 including the first end portion side diaphragm 61, the first diaphragm 63, the second diaphragm 64, the third diaphragm 65, the fourth diaphragm 66, the fifth diaphragm 67, the sixth diaphragm 68, and the second end portion side diaphragm 62. The plurality of diaphragms 60 are laminated in order in the axial direction and are mutually fixed by bolts, welding, or the like.

The first end portion side diaphragm 61 is disposed on the most upstream side in the axial direction (the first end portion P1 side) among the plurality of diaphragms 60. The first diaphragm 63 is disposed on the downstream side in the axial direction with respect to the first end portion side diaphragm 61. The second diaphragm 64 is disposed on the downstream side in the axial direction with respect to the first diaphragm 63. The third diaphragm 65 is disposed on the downstream side in the axial direction with respect to the second diaphragm 64. The fourth diaphragm 66 is disposed on the downstream side in the axial direction with respect to the third diaphragm 65. The fifth diaphragm 67 is disposed on the downstream side in the axial direction with respect to the fourth diaphragm 66. The sixth diaphragm 68 is disposed on the downstream side in the axial direction with respect to the fifth diaphragm 67. The second end portion side diaphragm 62 is disposed on the most downstream side in the axial direction (the second end portion P2 side) among the plurality of diaphragms 60.

The diaphragm 60 has a guide flow path A and a communication hole 70. According to one or more embodiments, among the plurality of diaphragms 60, the first diaphragm 63, the second diaphragm 64, the third diaphragm 65, the fourth diaphragm 66, the fifth diaphragm 67, and the sixth diaphragm 68 have a guide flow path A and the communication hole 70.

The guide flow path A guides the process gas G discharged radially outward from the impeller 30 radially inward. Accordingly, the guide flow path A introduces the process gas G discharged from the impeller 30 of the previous stage to the adjacent impeller 30 on the following stage in the axial direction. The communication hole 70 extends downward in a perpendicular direction from the bottom portion of the guide flow path A.

Here, specifically, the flow path formed by the diaphragm 60 including the guide flow path A will be described in order from the upstream side in the axial direction. According to one or more embodiments, the diaphragm group 6 includes a suction port 11, a suction flow path 12, a plurality of diffuser flow paths 13, a plurality of curved flow paths 14, a return flow path 15, a discharge flow path 16, and a discharge port 17, in order from the upstream side where the process gas G flows.

The suction port 11 causes the process gas G to flow into the suction flow path 12 from the outside. The suction port 11 causes the process gas G that has flowed in from the outside of the casing 10*a* to flow into the diaphragm group 6. The suction port 11 has a circular, oval, or rectangular portion opened on the outer circumferential side of the diaphragm group 6. The suction port 11 is a bottom portion positioned at the lowermost part in the perpendicular direction of the diaphragm group 6 and opens downward in the perpendicular direction. The suction port 11 is connected to the suction flow path 12 while gradually reducing the flow path area from the outside in the radial direction to the inside in the radial direction.

Together with the suction port 11, the suction flow path 12 has an inlet flow path which allows the process gas G to flow into the impeller 30 that corresponds to the first compressor stage 101 disposed on the most upstream side among a plurality of impellers 30 aligned in the axial direction from the outside. The suction flow path 12 extends to the inside in the radial direction from the suction port 11. The suction flow path 12 is connected to an inlet that faces the upstream side in the axial direction of the impeller flow path 35 of the impeller 30 that corresponds to the first compressor stage 101 while changing the direction thereof from the radial direction to the downstream side in the axial direction. In the suction flow path 12, the shape of a section including the axis P is formed in an annular shape with the axis P as the center.

The diffuser flow path 13 is an outlet flow path into which the process gas G that has flowed out from the impeller flow path 35 of the impeller 30 to the radially outer circumferential side flows. The diffuser flow path 13 is connected to an outlet that faces the outside in the radial direction of the impeller flow path 35. The diffuser flow path 13 is a flow path that extends in the radial direction and forms a straight line in a radially sectional view. The diffuser flow path 13 on the most upstream side in the axial direction extends to the outside in the radial direction from the outlet of the impeller flow path 35 of the impeller 30 that corresponds to the first compressor stage 101 and is connected to the curved flow path 14.

The curved flow path 14 turns a flow direction of the process gas G from the direction toward the outside in the radial direction to the direction toward the inside in the radial direction. In other words, the curved flow path 14 is a flow path having a U shape in a radially sectional view. Among the flow paths that communicate with the impellers 30 which are adjacent to each other in the axial direction, the curved flow path 14 is provided on the most outer circumferential side in the radial direction in the diaphragm group 6.

The return flow path 15 is an inlet flow path which allows the process gas G that has flowed through the curved flow path 14 to flow into the impeller 30. While the return flow path 15 linearly extends in a radially sectional view toward the inside in the radial direction, a flow path width gradually widens. The return flow path 15 changes the flow direction of the process gas G on the inside in the radial direction of the diaphragm group 6 to the downstream side in the axial direction. The most upstream return flow path 15 in the axial direction is connected to an inlet that faces the upstream side in the axial direction of the impeller flow path 35 that corresponds to the second compressor stage 102 disposed on the downstream side in the axial direction. In the return flow path 15, a plurality of return vanes 150 having a wing-shaped section are provided in the circumferential direction so as to go across the flow path.

The return vane 150 deflects the process gas G from the curved flow path 14 in the return flow path 15 in a desired direction and guides the process gas G to the impeller flow path 35. The desired direction of the return vane 150 in accordance with one or more embodiments means, for example, a direction in which a swirling component of the process gas G from the impeller flow path 35 of the impeller 30 is removed, that is, a direction of being inclined to a rear side in a rotation direction of the impeller 30 with respect to the radial direction.

The diffuser flow path 13, the curved flow path 14, and the return flow path 15 configure the guide flow path A. In other words, the guide flow path A formed around the impeller 30 that corresponds to the first compressor stage 101 guides the process gas G discharged radially outward from the impeller 30 that corresponds to the first compressor stage 101 radially inward. Accordingly, the guide flow path A that corresponds to the first compressor stage 101 is introduced the process gas G into the impeller 30 that corresponds to the second compressor stage 102 which is adjacent to the first compressor stage 101 in the axial direction.

Regarding the guide flow path A formed around the impeller 30 that corresponds to the second compressor stage 102 disposed on the downstream side of the impeller 30 that corresponds to the first compressor stage 101, the description thereof will be omitted since a configuration thereof is similar to that of the guide flow path A that corresponds to the above-described first compressor stage 101. In addition, regarding the guide flow path A that corresponds to each of the third compressor stage 103, the fourth compressor stage 104, the fifth compressor stage 105, and the sixth compressor stage 106, the description thereof will be omitted since a configuration thereof is similar to that of the guide flow path A that corresponds to the above-described first compressor stage 101. In other words, the guide flow path A that corresponds to each of the second compressor stage 102, the third compressor stage 103, the fourth compressor stage 104, and the fifth compressor stage 105 is configured with the diffuser flow path 13, the curved flow path 14, and the return flow path 15.

The discharge flow path 16 is connected to the diffuser flow path 13 communicated with the outlet of the impeller flow path 35 of the impeller 30 that corresponds to the sixth compressor stage 106. The discharge flow path 16 extends to the outside in the radial direction from the diffuser flow path 13. The discharge flow path 16 is connected to the discharge port 17.

Together with the discharge flow path 16, the discharge port 17 is an outlet flow path which allows the process gas G to flow out from the impeller 30 that corresponds to the sixth compressor stage 106 disposed on the most downstream side among the plurality of impellers 30 arranged in the axial direction. The discharge port 17 discharges the process gas G from the inside of the diaphragm group 6 to the outside. The discharge port 17 has a circular, oval, or rectangular section opened on the outer circumferential side of the diaphragm group 6. The discharge port 17 opens downward in the bottom portion of the diaphragm group 6.

The first end portion side diaphragm 61 and the second end portion side diaphragm 62 accommodate the bearing **10*b* on the inside in the radial direction. The second end portion side diaphragm 62 is formed of the same material as that of the first end portion side diaphragm 61**.

The first diaphragm 63 is provided corresponding to the first compressor stage 101 among the plurality of compressor stages of the centrifugal compressor 100. The first diaphragm 63 is adjacent to the downstream side in the axial direction with respect to the first end portion side diaphragm 61 and is adjacent to the upstream side in the axial direction with respect to the second diaphragm 64. The first diaphragm 63 opposes the first end portion side diaphragm 61 in the axial direction. Accordingly, the first diaphragm 63 forms the suction port 11 and the suction flow path 12 together with the first end portion side diaphragm 61. A space capable of accommodating the impeller 30 therein is formed on the inside of the first diaphragm 63 in the radial direction. The first diaphragm 63 has the diffuser flow path 13 and the curved flow path 14 formed therein for allowing the process gas G discharged from the impeller 30 that corresponds to the first compressor stage 101 to flow.

The second diaphragm 64 is provided corresponding to the second compressor stage 102 among the plurality of compressor stages of the centrifugal compressor 100. The second diaphragm 64 is adjacent to the upstream side in the axial direction with respect to the third diaphragm 65. The second diaphragm 64 opposes the first diaphragm 63 in the axial direction. Accordingly, together with the first diaphragm 63, the second diaphragm 64 forms a return flow path 15 which allows the process gas G to flow to the impeller 30 that corresponds to the second compressor stage 102. The second diaphragm 64 has the diffuser flow path 13 and the curved flow path 14 formed therein for allowing the process gas G discharged from the impeller 30 that corresponds to the second compressor stage 102 to flow. A space capable of accommodating the impeller 30 therein is formed on the inside of the second diaphragm 64 in the radial direction.

The third diaphragm 65 is provided corresponding to the third compressor stage 103 among the plurality of compressor stages of the centrifugal compressor 100. The third diaphragm 65 is adjacent to the upstream side in the axial direction with respect to the fourth diaphragm 66. The third diaphragm 65 opposes the second diaphragm 64 in the axial direction. Accordingly, together with the second diaphragm 64, the third diaphragm 65 forms the return flow path 15 which allows the process gas G to flow into the impeller 30 that corresponds to the third compressor stage 103. The third diaphragm 65 has the diffuser flow path 13 and the curved flow path 14 formed therein for allowing the process gas G discharged from the impeller 30 that corresponds to the third compressor stage 103 to flow. A space capable of accommodating the impeller 30 therein is formed on the inside of the third diaphragm 65 in the radial direction.

The fourth diaphragm 66 is provided corresponding to the fourth compressor stage 104 among the plurality of compressor stages of the centrifugal compressor 100. The fourth diaphragm 66 is adjacent to the upstream side in the axial direction with respect to the fifth diaphragm 67. The fourth diaphragm 66 opposes the third diaphragm 65 in the axial direction. Accordingly, together with the third diaphragm 65, the fourth diaphragm 66 forms the return flow path 15 which allows the process gas G to flow into the impeller 30 that corresponds to the fourth compressor stage 104. The fourth diaphragm 66 has the diffuser flow path 13 and the curved flow path 14 formed therein for allowing the process gas G discharged from the impeller 30 that corresponds to the fourth compressor stage 104 to flow. A space capable of accommodating the impeller 30 therein is formed on the inside of the fourth diaphragm 66 in the radial direction.

The fifth diaphragm 67 is provided corresponding to the fourth compressor stage 104 among the plurality of compressor stages of the centrifugal compressor 100. The fifth diaphragm 67 is adjacent to the upstream side in the axial direction with respect to the sixth diaphragm 68. The fifth diaphragm 67 opposes the fourth diaphragm 66 in the axial direction. Accordingly, together with the fourth diaphragm 66, the fifth diaphragm 67 forms the return flow path 15 which allows the process gas G to flow into the impeller 30 that corresponds to the fifth compressor stage 105. The fifth diaphragm 67 has the diffuser flow path 13 and the curved flow path 14 formed therein for allowing the process gas G discharged from the impeller 30 that corresponds to the fifth compressor stage 105 to flow. A space capable of accommodating the impeller 30 therein is formed on the inside of the fifth diaphragm 67 in the radial direction.

The sixth diaphragm 68 is provided corresponding to the sixth compressor stage 106 among the plurality of compressor stages of the centrifugal compressor 100. The sixth diaphragm 68 is adjacent to the upstream side in the axial direction with respect to the second end portion side diaphragm 62. The sixth diaphragm 68 opposes the fifth diaphragm 67 in the axial direction. Accordingly, together with the fifth diaphragm 67, the sixth diaphragm 68 forms the return flow path 15 which allows the process gas G to flow into the impeller 30 that corresponds to the sixth compressor stage 106. A space capable of accommodating the impeller 30 therein is formed on the inside of the sixth diaphragm 68 in the radial direction. The sixth diaphragm 68 opposes the second end portion side diaphragm 62 in the axial direction. Accordingly, together with the second end portion side diaphragm 62, the sixth diaphragm 68 forms the diffuser flow path 13, the discharge flow path 16, and the discharge port 17 which allow the process gas G discharged from the impeller 30 that corresponds to the sixth compressor stage 106.

The casing 10*a* has a suction nozzle 18 and an ejection nozzle 19. The suction nozzle 18 is provided on the first end portion side in the axial direction. The suction nozzle 18 guides the process gas G from the outside of the casing 10*a* to the first stage impeller 30 that corresponds to the first compressor stage 101. The first stage impeller 30 is disposed on the closest side to first end portion in the axial direction of the impeller group 3. The suction nozzle 18 is provided on the bottom portion side in the casing 10*a*. The suction nozzle 18 is provided so as to extend downward in the perpendicular direction. The suction nozzle 18 is connected to the suction port 11.

The ejection nozzle 19 is provided on the second end portion side in the axial direction. The ejection nozzle 19 discharges the process gas G discharged from the impeller 30 of the final stage that corresponds to the sixth compressor stage 106 to the outside of the casing 10*a*. The final stage impeller 30 is disposed on the most second end portion side in the axial direction of the impeller group 3. The ejection nozzle 19 is provided on the bottom portion side in the casing 10*a*. The ejection nozzle 19 is provided so as to extend downward in the perpendicular direction. The ejection nozzle 19 is connected to the discharge port 17. In other words, the ejection nozzle 19 is disposed with a space in the axial direction with respect to the suction nozzle 18.

Figure 2:
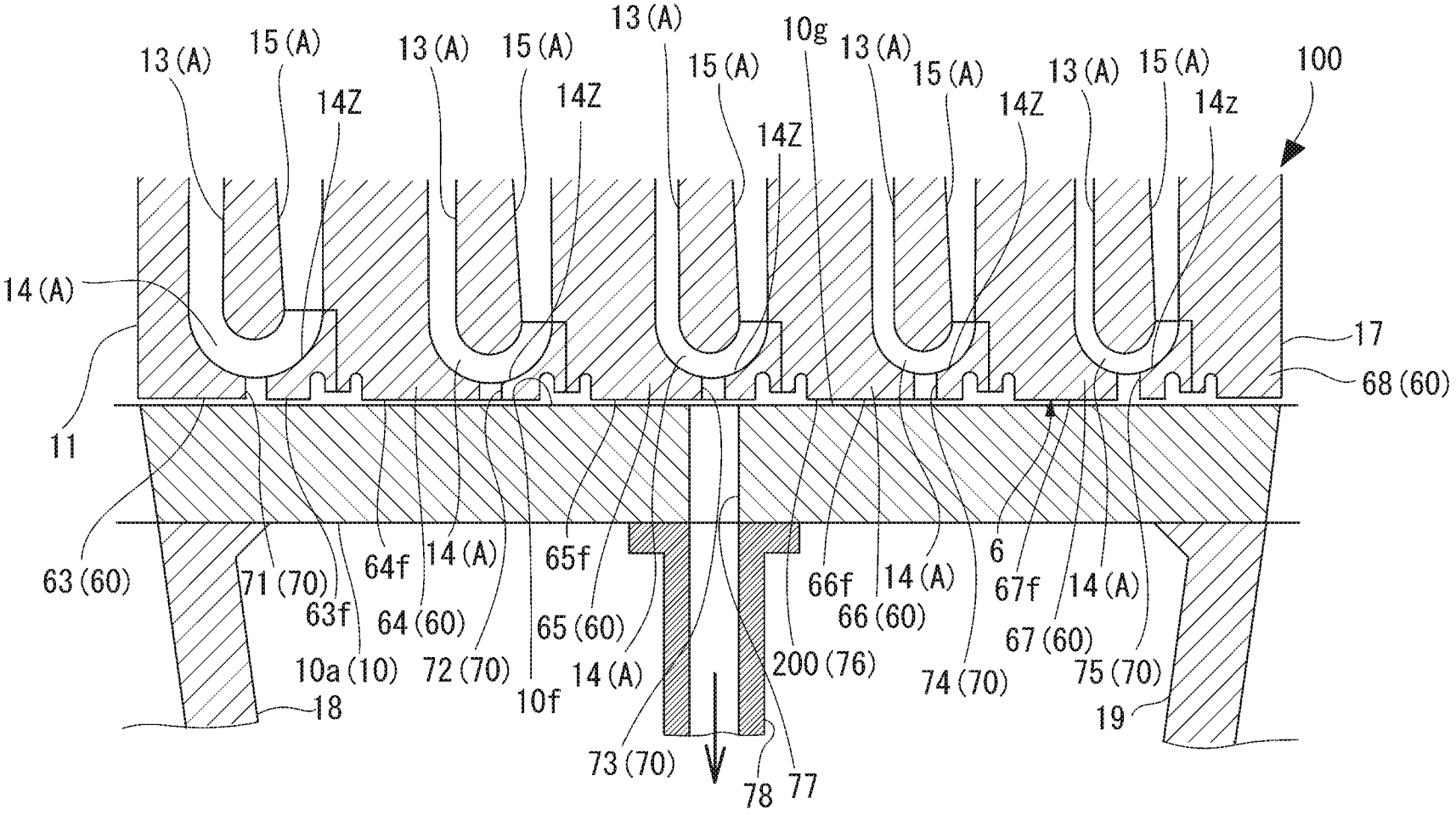
FIG. 2 is a sectional view illustrating a communication hole, an axial flow path, a drain flow path, and a drain pipe which are provided in the multi-stage centrifugal compressor according to one or more embodiments of the invention.

As illustrated in FIG. 2, the communication hole 70 extends downward in the perpendicular direction from the curved flow path 14 of each of the diaphragms 60. The communication hole 70 causes the bottom portion positioned at the lowermost part in the perpendicular direction in the curved flow path 14 to communicate with the lower outer circumferential surface of the diaphragm 60 in the perpendicular direction to each other.

The first diaphragm 63 includes a first communication hole 71 which extends downward from a bottom portion 14*z* of the curved flow path 14. The first communication hole 71 opens on a lower outer circumferential surface 63*f* of the first diaphragm 63. The lower outer circumferential surface 63*f* is a region positioned at the lowermost part in the perpendicular direction on the outer circumferential surface of the first diaphragm 63.

The second diaphragm 64 includes a second communication hole 72 which extends downward from the bottom portion 14*z* of the curved flow path 14. The second communication hole 72 opens on a lower outer circumferential surface 64*f* of the second diaphragm 64. The lower outer circumferential surface 64*f* is a region positioned at the lowermost part in the perpendicular direction on the outer circumferential surface of the second diaphragm 64. The position of the second communication hole 72 in the circumferential direction is formed at a position which is the same as the first communication hole 71.

The third diaphragm 65 includes a third communication hole 73 which extends downward from the bottom portion 14*z* of the curved flow path 14. The third communication hole 73 opens on a lower outer circumferential surface 65*f* of the third diaphragm 65. The lower outer circumferential surface 65*f* is a region positioned at the lowermost part in the perpendicular direction on the outer circumferential surface of the third diaphragm 65. The position of the third communication hole 73 in the circumferential direction is formed at a position which is the same as the second communication hole 72.

The fourth diaphragm 66 includes a fourth communication hole 74 which extends downward from the bottom portion 14*z* of the curved flow path 14. The fourth communication hole 74 opens on a lower outer circumferential surface 66*f* of the fourth diaphragm 66. The lower outer circumferential surface 66*f* is a region positioned at the lowermost part in the perpendicular direction on the outer circumferential surface of the fourth diaphragm 66. The position of the fourth communication hole 74 in the circumferential direction is formed at a position which is the same as the third communication hole 73.

The fifth diaphragm 67 includes a fifth communication hole 75 which extends downward from the bottom portion 14*z* of the curved flow path 14. The fifth communication hole 75 opens on a lower outer circumferential surface 67*f* of the fifth diaphragm 67. The lower outer circumferential surface 67*f* is a region positioned at the lowermost part in the perpendicular direction on the outer circumferential surface of the fifth diaphragm 67. The position of the fourth communication hole 74 in the circumferential direction is formed at a position which is the same as the fourth communication hole 74.

In the casing unit 10, an axial flow path 200 that extends in the axial direction so as to connect the plurality of communication holes 70 to each other is formed. The axial flow path 200 in accordance with one or more embodiments is formed by a gap 76 provided between the outer circumferential surface of the plurality of diaphragms 60 and the inner circumferential surface of the casing 10*a*. The gap 76 is formed between the bottom inner circumferential surface 10*f* of the casing 10*a*, and the lower outer circumferential surface 63*f* of the first diaphragm 63, the lower outer circumferential surface 64*f* of the second diaphragm 64, the lower outer circumferential surface 65*f* of the third diaphragm 65, the lower outer circumferential surface 66*f* of the fourth diaphragm 66, and the lower outer circumferential surface 67*f* of the fifth diaphragm 67. The axial flow path 200 connects the first communication hole 71 and the fifth communication hole 75 which are positioned in both of the end portions in the axial direction in the diaphragm group 6 to each other. The axial flow path 200 in accordance with one or more embodiments connects the first communication hole 71, the second communication hole 72, the third communication hole 73, the fourth communication hole 74, and the fifth communication hole 75 to each other. The axial flow path 200 is formed to be continuous along the axial direction between the first communication hole 71 and the fifth communication hole 75.

The gap 76 can be formed by reducing a lower part in the perpendicular direction in the outer diameter of the first end portion side diaphragm 61, the first diaphragm 63, the second diaphragm 64, the third diaphragm 65, the fourth diaphragm 66, and the fifth diaphragm 67, to be smaller than the inner diameter of the bottom inner circumferential surface 10*f* at a lower part of the casing 10*a* in the perpendicular direction by a predetermined length.

In addition, the gap 76 may be formed such that the inner diameter of the casing 10*a* is enlarged at least in the lower end portion such that the inner diameter of the bottom inner circumferential surface 10*f* of the lower end portion of the casing 10*a* is greater than the outer diameter of the plurality of diaphragms 60.

In the casing 10*a*, a drain flow path 77 which causes the axial flow path 200 and the outside of the casing 10*a* to communicate with each other in the bottom portion. The drain flow path 77 is provided only on the inside in the axial direction with respect to one pair of communication holes positioned on the first end portion side and the second end portion side in the axial direction. In other words, the drain flow path 77 is provided only between the first communication hole 71 formed at a position that is the closest to the suction nozzle 18 in the axial direction, and the fifth communication hole 75 formed at a position that is the closest to the ejection nozzle 19 in the axial direction. Only one drain flow path 77 is provided. The drain flow path 77 is formed at a position at which the position in the axial direction does not overlap the suction nozzle 18 and the ejection nozzle 19. The drain flow path 77 is formed at a position at which the position in the axial direction does not overlap the first communication hole 71 and the fifth communication hole 75. It is preferable that the drain flow path 77 be formed immediately below the communication hole 70 close to the center in the axial direction of the rotor main body 20 among the plurality of communication holes 70. The drain flow path 77 in accordance with one or more embodiments is formed such that the position in the axial direction overlaps the third communication hole 73.

A drain pipe 78 is connected to the bottom portion of the casing 10*a* so as to communicate with the drain flow path 77. The drain pipe 78 extends downward in the perpendicular direction from the casing 10*a*. An opening and closing valve (not illustrated) is provided in the drain pipe 78. The drain pipe 78 can discharge the fluid from the axial flow path 200 through the drain flow path 77 by opening the opening and closing valve. Only one drain pipe 78 in accordance with one or more embodiments is provided so as to correspond to the drain flow path 77.

In the centrifugal compressor 100, in a case where the process gas G which remains in the flow path in the casing unit 10 is liquefied at the time of stopping the operation or the like, the liquefied process gas G is accumulated as a drain liquid (liquid) in the bottom portion 14*z* of the curved flow path 14 of each stage.

The drain liquid accumulated in the bottom portion 14*z* of the curved flow path 14 passes through the first communication hole 71, the second communication hole 72, the third communication hole 73, the fourth communication hole 74, the fifth communication hole 75, and flows into the lower axial flow path 200. The drain liquid that has flowed into the axial flow path 200 flows into the drain pipe 78 via the drain flow path 77. When the opening and closing valve (not illustrated) of the drain pipe 78 opens, the drain liquid is discharged from the drain pipe 78 to the outside.

According to the centrifugal compressor 100 of the above-described embodiments, the drain liquid that exists in the curved flow paths 14 formed in the plurality of diaphragms 60 passes through each of the communication holes 70, and flows into the axial flow path 200 between the lower outer circumferential surfaces 63*f*, 64*f*, 65*f*, 66*f*, and 67*f* of the diaphragm 60 and the bottom inner circumferential surface (inner circumferential surface) 10*f* of the casing 10*a*. The drain liquid that has flown into the axial flow path 200 is discharged from the drain flow path 77 to the outside of the casing 10*a* through the drain pipe 78. The drain flow path 77 is provided on the inside in the axial direction with respect to one pair of communication holes 70 positioned on the first end portion P1 side and the second end portion P2 side in the axial direction. In other words, the drain flow path 77 is provided between the first communication hole 71 that is the closest to the first end portion P1 and the fifth communication hole 75 that is the closest to the second end portion P2. Therefore, it is possible to form the drain flow path 77 on the inside of the suction nozzle 18 in the axial direction and on the inside of the ejection nozzle 19 in the axial direction. Therefore, the drain pipe 78 connected to the drain flow path 77 can be disposed at a position that does not interfere with the suction nozzle 18 and the ejection nozzle 19. In other words, even when there is a member disposed on the outside of the casing 10*a* similar to the drain pipe 78, it is possible to dispose the member at a position that does not interfere with the suction nozzle 18 and the ejection nozzle 19.

Accordingly, it is not necessary to widen the interval between the suction nozzle 18 and the ejection nozzle 19 in order to provide the drain flow path 77 and the drain pipe 78. In other words, the drain flow path 77 and the drain pipe 78 can be provided without lengthening the rotor main body 20. Therefore, the natural frequency of the rotor 2 becomes low, and it is possible to suppress the natural frequency of the rotor 2 from being close to the rotational frequency of the rotor 2 during an operation of the centrifugal compressor 100 and decreasing and resonating. In this manner, it is possible to provide the drain pipe 78 while avoiding interference between the suction nozzle 18 and the ejection nozzle 19 without lengthening the rotor main body 20.

In addition, the axial flow path 200 is formed by the gap 76 provided between the lower outer circumferential surfaces 63*f*, 64*f*, 65*f*, 66*f*, and 67*f* of the diaphragm 60 and the bottom inner circumferential surface 10*f* of the casing 10*a*. According to the configuration, when the diaphragm group 6 is provided to be fixed to the casing 10*a*, the gap 76 formed between the lower outer circumferential surfaces 63*f*, 64*f*, 65*f*, 66*f*, and 67*f* of the diaphragm 60 and the bottom inner circumferential surface 10*f* of the casing 10*a* can be defined as the axial flow path 200. Therefore, in order to form the axial flow path 200, it is unnecessary to form grooves or the like by processing, and the axial flow path 200 can be provided at low cost.

In addition, only one drain flow path 77 is provided on the inside in the axial direction between the first communication hole 71 and the fifth communication hole 75 which are positioned on both sides in the axial direction. According to the configuration, it is possible to provide the minimum number of drain flow paths 77 so as not to reliably interfere with the suction nozzle 18 and the ejection nozzle 19.

A centrifugal compressor 100A of one or more embodiments below is different from the centrifugal compressor 100 of one or more embodiments above only in the axial flow path 200. Therefore, in the description of these embodiments, the same reference numerals will be given to the same parts as those of one or more embodiments above, and redundant description thereof will be omitted. In other words, description of the overall configuration of the centrifugal compressor 100 common to the configuration described in one or more embodiments above will be omitted.

In one or more embodiments, the axial flow path 200A is configured with a groove 76*m* recessed on the outer circumferential surface of the diaphragm 60. In other words, the axial flow path 200 is not limited to the configuration formed by the gap 76 between the outer circumferential surface of the plurality of diaphragms 60 and the bottom inner circumferential surface 10*f* in the lower end portion of the casing 10*a*.

Figure 3:
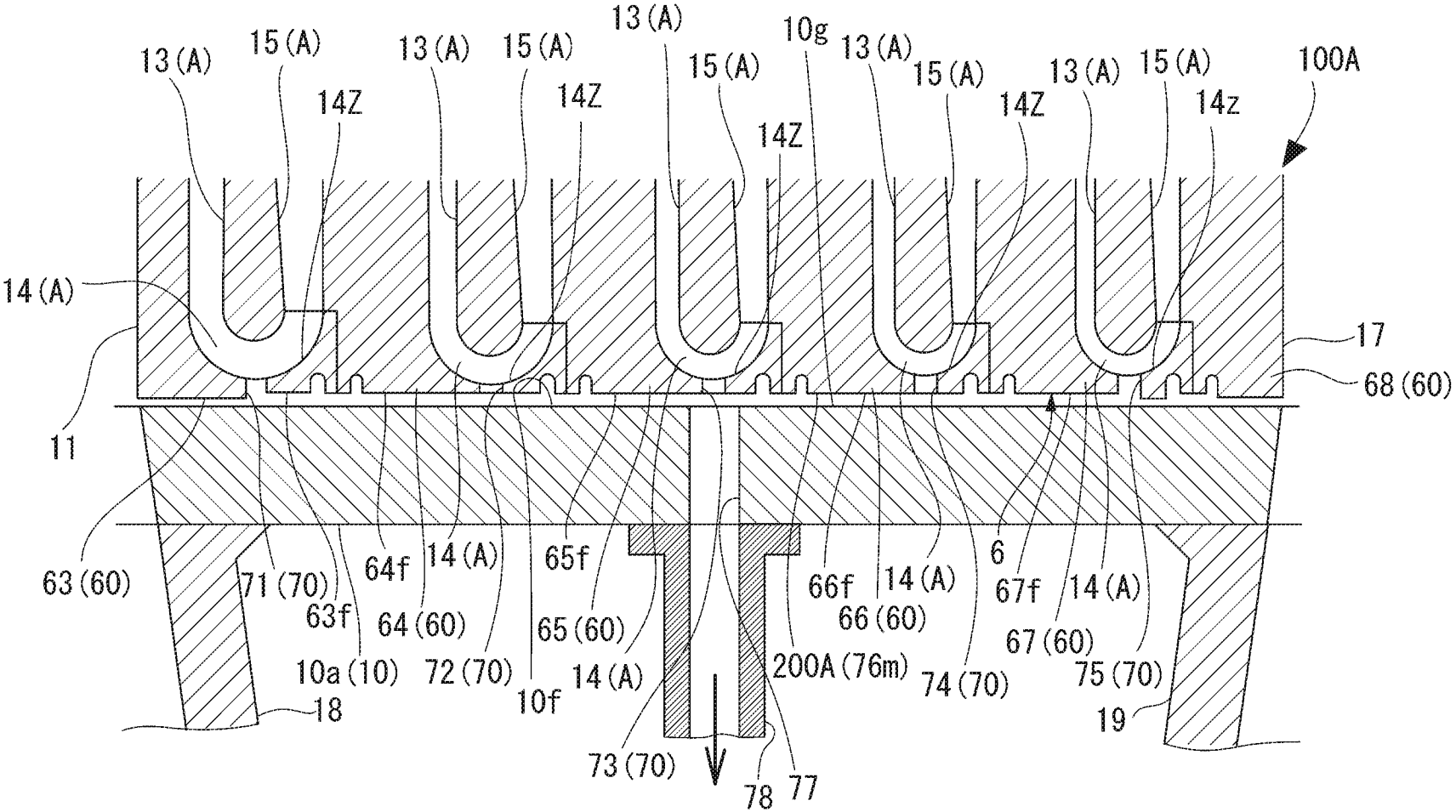
FIG. 3 is a sectional view illustrating a communication hole, an axial flow path, a drain flow path, and a drain pipe according to a modification example of one or more embodiments of the invention.

Specifically, as illustrated in FIG. 3, it is possible to form the axial flow path 200A by forming the groove 76*m* continuous in the axial direction at part of the outer circumferential surface of the plurality of diaphragms 60 that forms the gap 76. By the configuration, it is possible to arbitrarily set the flow path sectional area of the axial flow path 200 by adjusting the amount by which the groove 76*m* is recessed from the outer circumferential surface of the diaphragm 60. Therefore, it is possible to provide the axial flow path 200A having a sufficient flow path sectional area in a necessary region in the axial direction.

A centrifugal compressor 100B of one or more embodiments below is different from the centrifugal compressor 100 of one or more embodiments above only in that a suction portion is provided as discharge assisting means for urging drain water from the drain pipe 78 to be discharged. Therefore, in the description of these embodiments, the same reference numerals will be given to the same parts as those of one or more embodiments above, and redundant description thereof will be omitted. In other words, description of the overall configuration of the centrifugal compressor 100 common to the configuration described in one or more embodiments above will be omitted.

Figure 4:
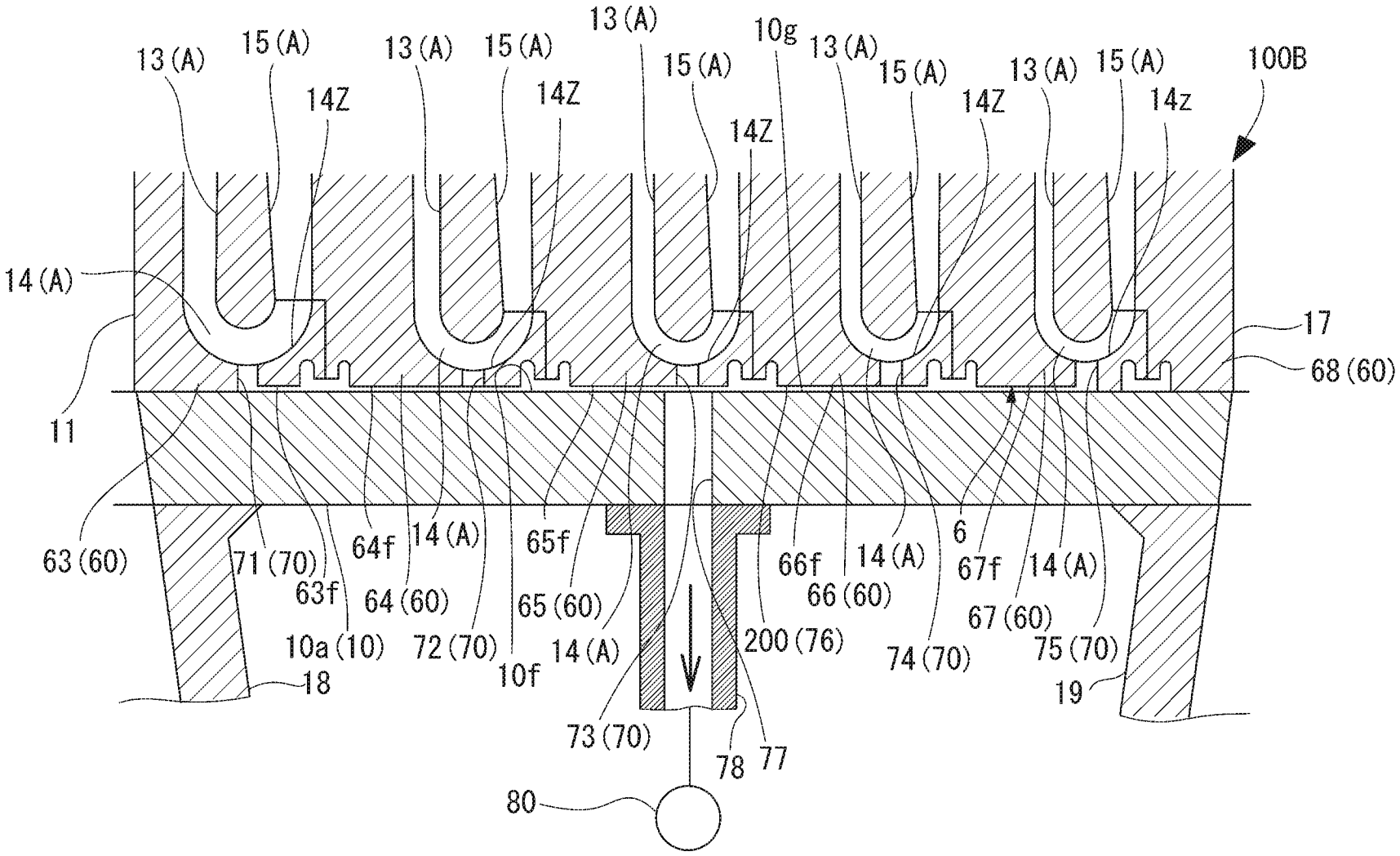
FIG. 4 is a sectional view illustrating a communication hole, an axial flow path, a drain flow path, and a drain pipe which are provided in the multi-stage centrifugal compressor according to one or more embodiments of the invention.

As illustrated in FIG. 4, a negative pressure source, such as a blower (suction portion) 80 or the like is connected to the drain pipe 78 in accordance with one or more embodiments. By operating, the blower 80 sets the inside of the drain pipe 78 and the drain flow path 77 to a negative pressure state and can suction out the liquid in the casing unit 10 from the gap 76 which is the axial flow path 200 through the drain flow path 77 and the drain pipe 78.

In the centrifugal compressor 100B in accordance with one or more embodiments, the liquid that has flowed into the axial flow path 200 from the communication hole 70 provided in the plurality of stages of the curved flow path 14 can be suctioned out by the blower 80. Therefore, it is possible to reliably discharge the liquid from the drain flow path 77 to the outside of the casing 10*a* through the drain pipe 78.

In addition, the invention is not limited to the above-described embodiments, and the design can be changed without departing from the gist of the embodiments of the present invention.

For example, in one or more embodiments above, only one drain flow path 77 and only one drain pipe 78 are disposed at an inner position in the axial direction than the first communication hole 71 and the fifth communication hole 75 which are positioned at both of the end portions in the axial direction, but the invention is not limited thereto. A plurality of sets of the drain flow paths 77 and the drain pipes 78 may be provided as long as the drain flow paths 77 and the drain pipe 78 are positioned on the inside of the first communication hole 71 in the axial direction and the fifth communication hole 75 which are positioned at both of the end portions in the axial direction.

Further, the gap 76 or the groove 76*m* which is in the axial flow path 200, is not limited to being parallel to the axis but may be inclined with respect to the axis. Therefore, for example, it is also possible to form the bottom inner circumferential surface 10*f* of the casing 10*a* being inclined so as to gradually lower down toward the drain flow path 77.

In addition, in one or more embodiments above, only one diaphragm group 6 including a plurality of diaphragms 60 is provided in the casing unit 10, but a plurality of diaphragm groups may be provided. In this case, in each of the diaphragm groups, the drain flow path 77 and the drain pipe 78 are provided further on the inner side in the axial direction than one pair of communication holes positioned at both of the end portions in the axial direction. According to this, in each of the diaphragm groups, it is possible to suppress the drain flow path 77 and the drain pipe 78 from interfering with the suction nozzle 18 or the ejection nozzle 19.

INDUSTRIAL APPLICABILITY

By providing the drain flow path to which the drain pipe is connected only on the inside of the pair of communication holes positioned on the first end portion side and the second end portion side in the axial direction, it is possible to provide the drain pipe while avoiding interference between the suction nozzle and the ejection nozzle without lengthening the rotor main body.

REFERENCE SIGNS LIST

2 ROTOR
3 IMPELLER GROUP
6 DIAPHRAGM GROUP
10 CASING UNIT
10*a* CASING
10*b* BEARING
10*f* BOTTOM INNER CIRCUMFERENTIAL SURFACE (INNER CIRCUMFERENTIAL SURFACE)
11 SUCTION PORT
12 SUCTION FLOW PATH
13 DIFFUSER FLOW PATH
14 CURVED FLOW PATH
14*z* BOTTOM PORTION

15 RETURN FLOW PATH
16 DISCHARGE FLOW PATH
17 DISCHARGE PORT
18 SUCTION NOZZLE
19 EJECTION NOZZLE
20 ROTOR MAIN BODY
20*a* ONE END
20*b* OTHER END
30 IMPELLER
31 DISK
32 BLADE
33 COVER
35 IMPELLER FLOW PATH
60 DIAPHRAGM
61 FIRST END PORTION SIDE DIAPHRAGM
62 SECOND END PORTION SIDE DIAPHRAGM
63 FIRST DIAPHRAGM
63*f* LOWER OUTER CIRCUMFERENTIAL SURFACE
64 SECOND DIAPHRAGM
64*f* LOWER OUTER CIRCUMFERENTIAL SURFACE
65 THIRD DIAPHRAGM
65*f* LOWER OUTER CIRCUMFERENTIAL SURFACE
66 FOURTH DIAPHRAGM
66*f* LOWER OUTER CIRCUMFERENTIAL SURFACE
67 FIFTH DIAPHRAGM
67*f* LOWER OUTER CIRCUMFERENTIAL SURFACE
68 SIXTH DIAPHRAGM
70 COMMUNICATION HOLE
71 FIRST COMMUNICATION HOLE
72 SECOND COMMUNICATION HOLE
73 THIRD COMMUNICATION HOLE
74 FOURTH COMMUNICATION HOLE
75 FIFTH COMMUNICATION HOLE
76 GAP
76*m* GROOVE
77 DRAIN FLOW PATH
78 DRAIN PIPE
80 BLOWER (SUCTION PORTION)
100, 100A, 100B CENTRIFUGAL COMPRESSOR (MULTI-STAGE CENTRIFUGAL COMPRESSOR)
101 FIRST COMPRESSOR STAGE
102 SECOND COMPRESSOR STAGE
103 THIRD COMPRESSOR STAGE
104 FOURTH COMPRESSOR STAGE
105 FIFTH COMPRESSOR STAGE
106 SIXTH COMPRESSOR STAGE
150 RETURN VANE
200, 200A AXIAL FLOW PATH
A GUIDE FLOW PATH
G PROCESS GAS (WORKING FLUID)
P AXIS
P1 FIRST END
P2 SECOND END

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A multi-stage centrifugal compressor comprising:
a rotor that comprises:
a rotor main body that extends in an axial direction; and
a plurality of impellers fixed to an outer surface of the rotor main body and disposed in a plurality of stages in the axial direction;
a plurality of diaphragms arranged in the axial direction, wherein each of the diaphragms comprises:
a guide flow path that guides a fluid discharged radially outward from one of the impellers radially inward; and
a communication hole that extends downward in a perpendicular direction from a bottom portion of the guide flow path;
a casing that accommodates the plurality of the diaphragms;
an axial flow path that extends in the axial direction and connects the communication holes to each other; and
a drain pipe that extends downward in the perpendicular direction from the casing,
wherein the casing comprises:
a suction nozzle disposed on a first end portion side that extends downward in the perpendicular direction, and
guides a working fluid from outside of the casing to one of the impellers that is on a first stage on the first end portion side;
an ejection nozzle disposed on a second end portion side that
extends downward in the perpendicular direction, and
ejects the working fluid discharged from one of the impellers disposed on a final stage on the second end portion side, to outside of the casing; and
a drain flow path disposed in the axial direction only between the communication hole that is closest to the suction nozzle and the communication hole that is closest to the ejection nozzle,
wherein the drain flow path causes the axial flow path and the outside of the casing to communicate with each other by communicating with the drain pipe,
wherein the axial flow path is formed between an outer circumferential surface of the diaphragms and an inner circumferential surface of the casing, and
wherein the inner circumferential surface of the casing is inclined gradually down toward the drain flow path.

2. The multi-stage centrifugal compressor according to claim 1, wherein the axial flow path is formed by a gap between the outer circumferential surface of the diaphragms and the inner circumferential surface of the casing.

3. The multi-stage centrifugal compressor according to claim 1, wherein the axial flow path is formed by a groove recessed from the outer circumferential surface of the diaphragms.

4. The multi-stage centrifugal compressor according to claim 1, wherein the casing includes only one drain flow path.

5. The multi-stage centrifugal compressor according to claim 1, further comprising a suction portion that suctions out the fluid from the axial flow path.

6. The multi-stage centrifugal compressor according to claim 2, wherein the casing includes only one drain flow path.

7. The multi-stage centrifugal compressor according to claim 3, wherein the casing includes only one drain flow path.

8. The multi-stage centrifugal compressor according to claim 2, further comprising a suction portion that suctions out the fluid from the axial flow path.

9. The multi-stage centrifugal compressor according to claim 3, further comprising a suction portion that suctions out the fluid from the axial flow path.

10. The multi-stage centrifugal compressor according to claim 4, further comprising a suction portion that suctions out the fluid from the axial flow path.

11. The multi-stage centrifugal compressor according to claim 6, further comprising a suction portion that suctions out the fluid from the axial flow path.

12. The multi-stage centrifugal compressor according to claim 7, further comprising a suction portion that suctions out the fluid from the axial flow path.

* * * * *